US005624060A

United States Patent [19]

Ellion et al.

[11] Patent Number: 5,624,060

[45] Date of Patent: Apr. 29, 1997

[54] INVERTIBLE DISPENSING SYSTEM AND DIP TUBE

[76] Inventors: M. Edmund Ellion, P.O. Box 645, Santa Ynez, Calif. 93460; James C. Pfautz, 12630 Hogue La., Bealeton, Va. 22712

[21] Appl. No.: 432,250

[22] Filed: May 2, 1995

[51] Int. Cl.[6] ..... B67D 5/40

[52] U.S. Cl. ..... 222/376; 222/382; 222/402.19; 222/464.2; 222/464.7

[58] Field of Search ..... 239/334, 342; 222/376, 382, 402.19, 464.2, 464.4, 464.7

[56] References Cited

U.S. PATENT DOCUMENTS

| | | | |
|---|---|---|---|
| 2,630,942 | 3/1953 | Shaffer | 239/342 X |
| 3,545,488 | 12/1970 | Venus, Jr. | 222/376 X |
| 5,195,664 | 3/1993 | Rhea | 222/382 X |
| 5,518,150 | 5/1996 | Witt, Jr. | 222/382 X |

FOREIGN PATENT DOCUMENTS

| | | | |
|---|---|---|---|
| 3929064 | 1/1991 | Germany | 222/376 |

*Primary Examiner*—Gregory L. Huson
*Attorney, Agent, or Firm*—Gregory Garmong

[57] ABSTRACT

In a dispensing system such as a pressurized can or hand-pumped bottle, a liquid to be dispensed from a container flows through a composite dip tube that feeds an inlet of a liquid transfer device. The dip tube includes a straight dip tube that extends from the inlet to the bottom of the container and a U-shaped tube that extends from the inlet to the bottom of the container and then returns to the top of the interior of the container. The U-shaped tube acts as a siphon that, in combination with the conventional tip tube, provides liquid to the liquid transfer device when the container is upright, inverted, or oriented in any other position as long as one of the two open ends of the dip tube is in communication with the liquid.

16 Claims, 4 Drawing Sheets

INVERTIBLE DISPENSING SYSTEM AND DIP TUBE

BACKGROUND OF THE INVENTION

This invention relates to a dispensing system for a liquid, and, more particularly, to dispensing systems such as hand-pumped spray bottles and hand-held spray cans.

Familiar types of liquid dispensing systems employ a dip tube to convey the liquid to be dispensed from the interior of a container to a liquid transfer device, such as a spray nozzle or a hand pump affixed to the container. One of the problems with such liquid dispensing systems is that they will not dispense the liquid unless the dip tube is in contact with the liquid inside the container. As a consequence, the container must be held substantially vertical unless it is completely full of the liquid.

It is highly desirable to be able to dispense the liquid while holding the container at various orientations in addition to the conventional vertical spraying orientation. Such situations include, for example, applying lubricant to the underside of a machine; applying paint to the deck or ceiling of a compartment; applying window cleaning to the bottom section of a glass door; and applying cleaner to the underside of a toilet bowl, as well as many other applications. The standard dip tube approach cannot provide a liquid flow in these situations and other applications where the surface to be treated is not vertical to the spray.

Various approaches have been proposed to solve this problem. In one, as disclosed in U.S. Pat. Nos. 4,322,020 and 3,257,036, the liquid within the container is enclosed in a bladder. This approach is effective and useful for some applications, but the bladder is subject to leaks and is relatively expensive to manufacture and implement. Additionally, extensive modifications are required to the filling apparatus that loads the liquid into the bladder and container, as compared with systems utilizing a dip tube. In a second approach, as disclosed in U.S. Pat. Nos. 4,775,879 and 3,733,013, the dip tube assembly utilizes a gravity-activated valve. Such dip tubes do not allow the dispensing system to be operated at intermediate orientations between the fully upright and the fully inverted.

Accordingly, there is a need for an improved liquid dispensing system that permits dispensing over a full range of orientations. The present invention fulfills this need, and further provides related advantages.

SUMMARY OF THE INVENTION

The present invention provides a liquid dispensing device and dip tube used in the liquid dispensing system. The liquid dispensing system can be operated at any orientation, including vertical upright, vertical inverted, and orientations intermediate between these two extremes. The mechanism is reliable and inexpensively implemented, and requires no alteration to the liquid transfer device of the dispensing system. The liquid dispensing system can be filled with liquid using conventional filling machinery.

In accordance with the invention, a dispensing system comprises a container operable to hold a liquid, a liquid transfer device having an inlet which receives liquid and transfers the liquid from the container, and a dip tube extending from the inlet into an interior of the container. The dip tube comprises a straight portion and a U-shaped portion. The straight portion of the dip tube includes a first segment having a first end in communication with the inlet and a second end extending to a bottom of an interior of the container, with the second end being open. The U-shaped portion includes a second segment having a first end in communication with the inlet and a second end extending to the bottom of the interior of the container, and a third segment having a first end in communication with the second end of the second segment and a second end extending to a top of the interior of the container, with the second end being open.

The liquid transfer device, such as a hand pump or aerosol spray head, can be integrally attached to the container or separate from the container. In either case, the dip tube extends from the inlet of the liquid transfer device into the interior of the container. The straight portion of the dip tube extends from the inlet of the liquid transfer device to the bottom of the container, where the straight dip tube has an open end. The U-shaped portion of the dip tube also extends from the inlet of the liquid transfer device, but reaches to the bottom of the container and then returns to the top of the container, where it has an open end.

When the container of the dispensing system is filled with liquid, the liquid transfer device is briefly actuated to fill the dip tube assembly with liquid. If the dispensing system is operated in the vertical upright position, the liquid flows through the straight portion of the dip tube and is dispensed. The liquid also flows into the U-shaped portion of the dip tube to maintain the liquid in the third segment having the open end at the same level as the liquid in the container and to maintain the second segment full of liquid. If the dispensing system is operated in the vertical inverted position, the liquid flows through the U-shaped portion of the dip tube to the liquid transfer device and maintains the liquid in the straight dip tube at the same level as the liquid in the container. The U-shaped portion of the dip tube acts as a siphon to maintain it full of liquid. The open ends of the straight portion and the U-shaped portion of the dip tube can be positioned adjacent to one side of the interior of the container, so that dispensing of liquid can be accomplished when the container is oriented in an intermediate position between fully upright and fully inverted.

Other features and advantages of the present invention will be apparent from the following more detailed description of the preferred embodiment, taken in conjunction with the accompanying drawings, which illustrate, by way of example, the principles of the invention.

DETAILED DESCRIPTION OF THE INVENTION

Figure 1B:
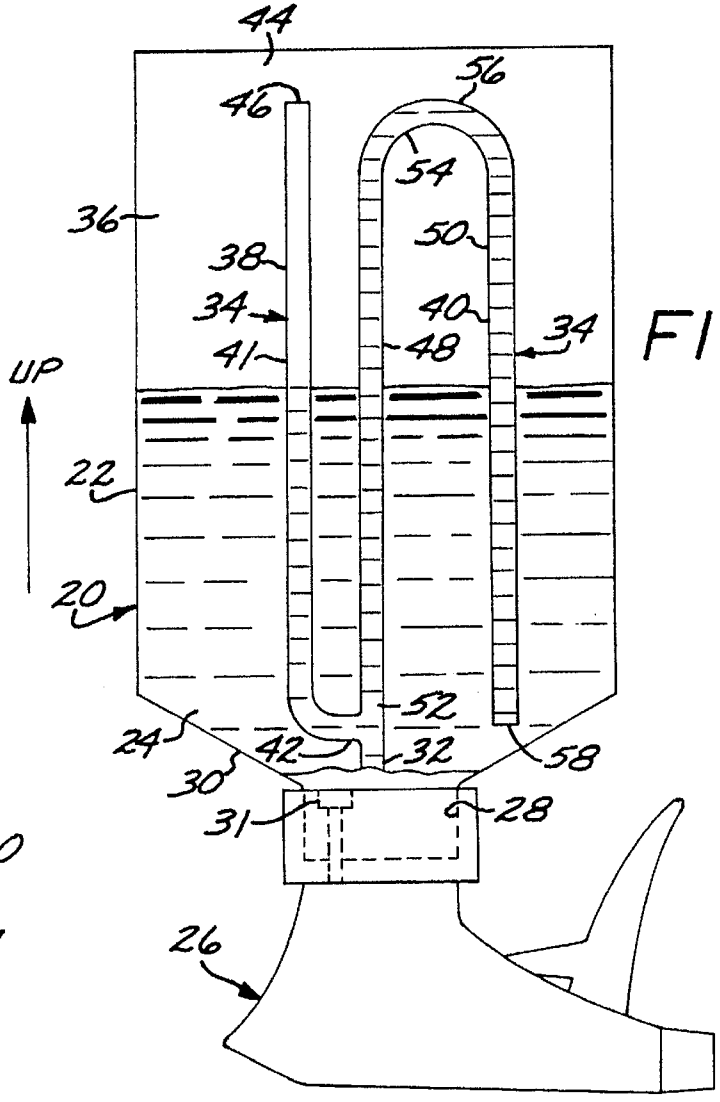
FIGS. 1(*a*)–1(*b*) are longitudinal sectional views of a manually operated dispensing system according to the invention, wherein FIG. 1(*a*) illustrates the dispensing system in the vertical upright position and FIG. 1(*b*) illustrates the dispensing system in the vertical inverted position.
Figure 1A:
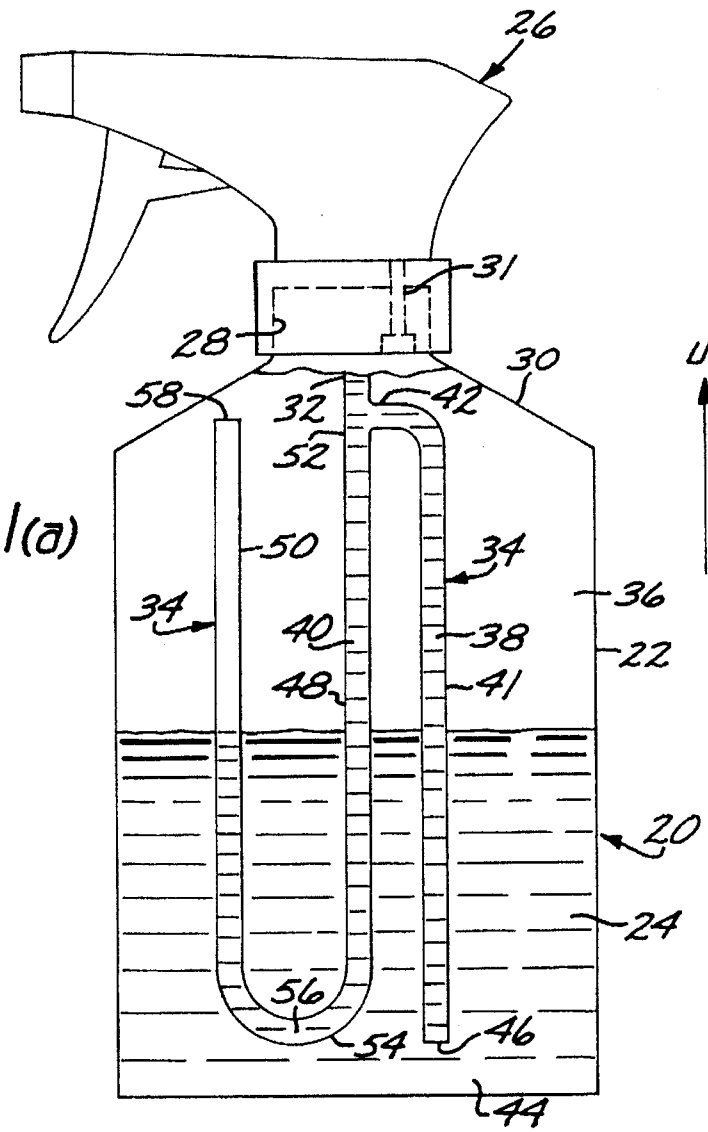

FIGS. 1 depict a dispensing system 20 having a container 22 that holds a liquid 24, and a liquid transfer device 26. In the illustrated embodiment, the liquid transfer device 26 is a hand-operated pump that is affixed to an opening 28 in a top 30 of the container 22. The liquid transfer device 26 can be any other operable type of apparatus capable of transferring liquid from the interior to the exterior of the container, such as an aerosol valve. The liquid transfer device 26 need not be affixed to the container, but can be separate from the container and in communication with the interior of the container in the manner discussed subsequently. In the embodiment of FIGS. 1 wherein the liquid transfer device 26 is a hand-operated pump affixed to the top of the container 22, there is desirably provided an air vent 31 through the body of the pump to provide for communication between the interior of the container 22 and its exterior. The air vent 31 is illustrated schematically in FIG. 1, and can take any of several forms. In less expensive dispensing systems of the hand-pump type, the air vent is a laterally slotted washer that operates satisfactorily if the dispensing system is upright, but can leak if the dispensing system is inverted. In other cases, the air vent 31 is open only during the pump pressure stroke, but seals at other times so that there is no leak when the dispensing system is in the inverted position. The present approach is operable with all such types of air vents.

The liquid transfer device 26 includes an inlet 32 and a dip tube 34 extending from the inlet 32 into an interior 36 of the container 22. (In FIGS. 1, the dip tube is drawn to a larger scale than the other elements for clarity of illustration.) The dip tube 34 includes two portions, a dip tube straight portion 38 and a dip tube U-shaped portion 40. As used herein, the term "straight" as applied to the portion 38 of the dip tube 34 indicates that the portion 38 is generally straight, as distinct from the general U-shape of the portion 40. The portion 38 need not be perfectly linear, and the portion 40 need not be perfectly U-shaped, and a flexible construction will be depicted in a subsequently described embodiment. The dip tube portions 38 and 40 are fluid transfer passages whose interior diameters are sized to accommodate the maximum fluid flow expected with the liquid transfer device 26.

The straight portion of the dip tube 38 is formed of a single, first segment 41 of tubing having a first end 42 in communication with the pump inlet 32. The straight portion of the dip tube 38 extends most of the length of the interior of the container 22, to a bottom end 44 of the interior 36 of the container 22. A second end 46 of the straight portion 38, positioned in the bottom end 44 of the container 22, is open and admits fluid to the straight portion of the dip tube 38 when the container is in the upright position, as shown in FIG. 1(*a*).

The U-shaped portion of the dip tube 38 includes two segments of tubing that are joined to form the continuous U-shaped portion. These two segments are termed a "second segment" 48 and a "third segment" 50 so as to avoid confusion with the "first segment" 41 of the straight portion of the dip tube 38. The second segment 48 has a first end 52 in communication with the pump inlet 32. The second segment 48 extends most of the length of the interior of the container 22, to the bottom end 44 of the container 22. The second segment 48 ends in a second end 54, which does not open directly to the body of liquid 24. The third segment 50 has a first end 56 that communicates with the second end 54 at a location in the bottom end 44 of the container 22. The third segment 50 returns back toward the top end 30 of the container 22, with a second end 58 located at the top end 30 of the container 22. The second end 58 is open and admits fluid to the straight U-shaped portion 40 when the container 22 is in the inverted position, as shown in FIG. 1(*b*).

When the dispensing system 20 is in a vertical upright orientation as shown in FIG. 1(*a*), a majority of the flow of liquid is conveyed from the body of liquid 24 to the liquid transfer device 26 through the straight portion of the dip tube 38. When the dispensing system is in a vertical inverted orientation as shown in FIG. 1(*b*), a majority of the flow of liquid is conveyed from the body of liquid 24 to the liquid transfer device 26 through the U-shaped portion of the dip tube 40. In each orientation, the non-flowing portion of the dip tube is partially filled with liquid so as to prevent gas from flowing to the liquid transfer device 26.

Figure 2A:
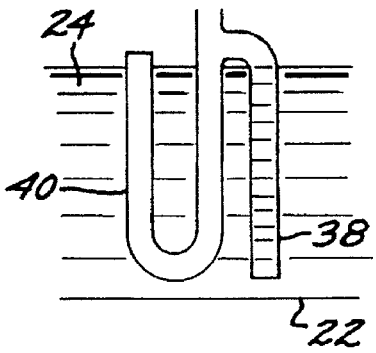
FIGS. 2(*a*)–2(*c*) are schematic sectional views of the dip tube of the dispensing system during the initial dispensing operation.
Figure 2B:
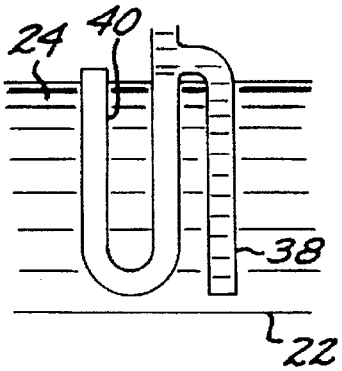
Figure 2C:
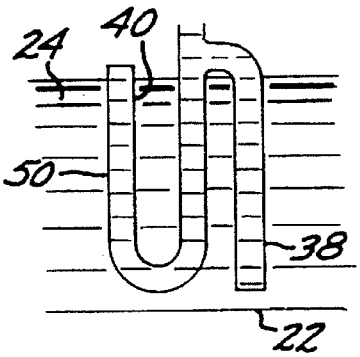

FIGS. 2 schematically illustrate the steps by which the dip tube 34 is initially supplied with liquid, or "primed". In FIG. 2(*a*), the container 22 is supplied with liquid 24 to the desired level. The liquid fills the straight portion of the dip tube 38 to the level of the container 22, and the U-shaped portion of the dip tube 38 is filled with air. The liquid transfer device 26 is briefly operated, as by pulling the trigger of the illustrated hand pump several times. Liquid is drawn up the straight portion of the dip tube 38 into the inlet 32 of the liquid transfer device 26, as shown in FIG. 2(*b*). Liquid is thereafter drawn by siphon action from the straight portion of the dip tube 38 into the second segment 48 of the U-shaped portion of the dip tube 40 and thence into the third segment 50 to the general level of the liquid 24, as shown in FIG. 2(*c*). If, on the other hand, the initial level of the liquid in the container 22 is above the top of the second segment 48, no pumping is required.

Figure 3A:
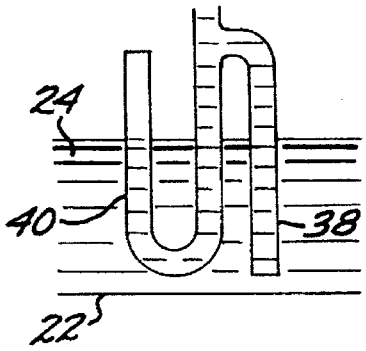
FIGS. 3(*a*)–3(*c*) are schematic sectional views of the dip tube of the dispensing system when the container is in the vertical upright position.
Figure 3B:
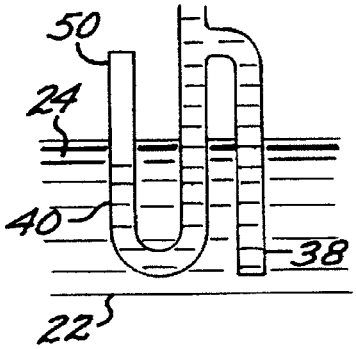
Figure 3C:
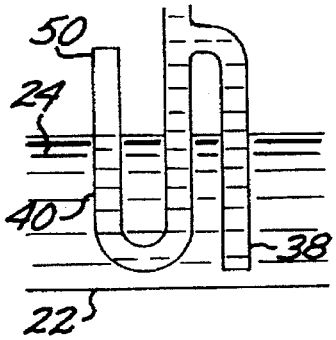

FIGS. 3 schematically illustrate the flow of liquid in the dispensing system 20 when the container 22 is in a vertical upright position, as in FIG. 1(*a*) , and the container is approximately half full of liquid 24. When the liquid transfer device 26 is not operating, a static equilibrium is reached, as shown in FIG. 3(*a*). When the liquid transfer device 26 operates, liquid flows through the straight portion of the dip tube 38, and the level of liquid in the third segment 50 of the U-shaped portion of the dip tube 40 drops momentarily, as seen in FIG. 3(*b*). As depicted in FIG. 3(*c*), the static equilibrium state is reestablished between pump actuations.

In order to prevent the liquid level in the third segment 50 from falling to the bottom of the U and then rising in the second segment 48 to the level of the liquid in the container 22, in which case air can rise into the second segment 48 and thence to the inlet 32 of the liquid transfer device, it is preferred to match the dip tube passage size (i.e., the inner diameter of the tube) to the pumping rate of the liquid transfer device 26. For a typical hand pump used as the liquid transfer device 26, the dip tube passages should be about 0.1 inch in diameter. For the most heavy-duty, high-flow hand pumps, the dip tube passages are enlarged to about 0.2 inch diameter.

Figure 4A:
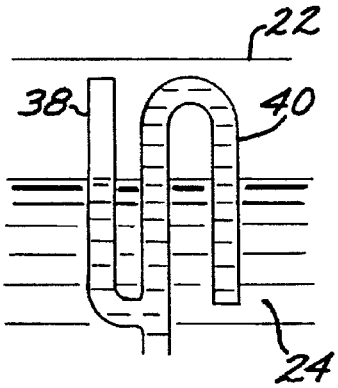
FIGS. 4(*a*)–4(*c*) are schematic sectional views of the dip tube of the dispensing system when the container is in the vertical inverted position.
Figure 4B:
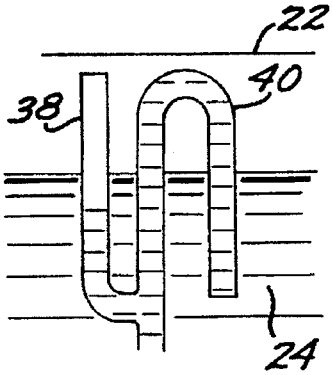
Figure 4C:
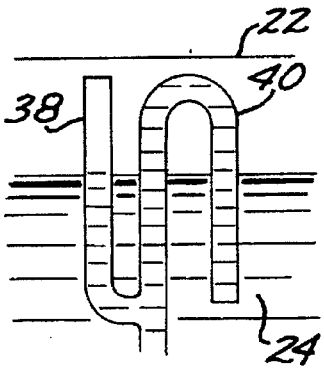

The same considerations apply when the liquid dispensing system is operated in the inverted position, as shown in FIGS. 4. In FIG. 4(*a*), when the liquid dispensing device is not operating, the U-shaped portion of the dip tube 40 is full of liquid, and the level in the straight portion of the dip tube 38 has a static equilibrium level the same as that of the general level of liquid in the container 22. While the liquid dispensing device operates, liquid flows through the U-shaped portion of the dip tube 40 by siphon action and the level of liquid in the straight portion of the dip tube 38 is drawn down, as shown in FIG. 4(*b*). The static equilibrium is regained when the operation of the liquid dispensing device is discontinued. These considerations also support the preferred matching of the dip tube passage sizes to the flow rate of the liquid dispensing device, as discussed previously.

FIGS. 3(*b*) and 4(*b*) illustrate that the liquid level in the segment that is in communication with the air in the container 22 will drop when the liquid transfer device 26 is actuated. The effective net pump suction head in the segment communicating with the air is less than in the segment in communication with the liquid 24. As a result, as the liquid level in the segment that is in communication with the air drops, the net pump suction head decreases, causing the flow from that segment to decrease until an equilibrium level is established. The equilibrium level depends on the dispensing flow rate and the density of the liquid being dispensed. The situation of FIGS. 3(*b*) and 4(*b*) can also be visualized at a time immediately after the dispensing operation ceases. There is an imbalance tending to cause the liquid level in the segment open to the air to rise to the level of the liquid in the container. There is thus a tendency for the liquid in that segment to flow opposite to the dispensing flow direction. The result is that when the liquid is at a certain position below the level in the container, the flow from that segment ceases. Tests have shown that the maximum drop in the liquid level, for a typical hand pump using dip tubes with 0.1 inch diameter flow passages and the pump positioned 8 inches above the level of water in the container, is approximately 0.09 inches. Similar values result for pressurized cans. For high flow rate hand pumps, the level drops a maximum of about 0.15 inches under the same conditions. A hydrodynamic analysis indicates, for the dispensing system in the upright orientation, that the drop $h_3$ in the liquid level in the third segment 50 is approximated as $$h_3=(\Delta P_a+\Delta P_b)/\rho,$$

where $\Delta P_a$ is the pressure drop due to the liquid flow in the straight portion of the dip tube 38, $\Delta P_b$ is the pressure drop in the second segment 48 of the U-shaped portion of the dip tube 40, and $\rho$ is the density of the liquid. That is, the faster the fluid flow as a result of the pump action, the greater the drop in the liquid level of the third segment. Similarly, when the dispensing system and its container are inverted, the drop $h_1$ in the liquid level in the straight portion of the dip tube is approximated as $$h_1=(\Delta P_c+\Delta P_b)/\rho,$$

where $\Delta P_c$ is the pressure drop due to the flow of the liquid in the third segment 50 of the U-shaped portion of the dip tube 40. In each case, the depression in the liquid level increases with increasing flow of the liquid.

It has been shown previously that, if the liquid level falls to the position where air can enter the other segment of the U-shaped dip tube during upright operations, the siphon action is terminated and the U-shaped dip tube becomes full of air while the straight portion of the dip tube in contact with the liquid becomes full of air to the level of the liquid in the container. A similar problem can arise in inverted operation.

Figure 5A:
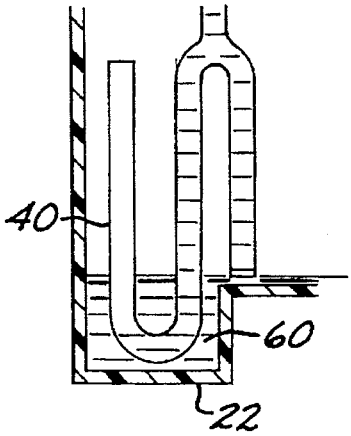
FIGS. 5(*a*)–5(*b*) are schematic sectional views of another embodiment of the dispensing system, utilizing a bottom sump, wherein FIG. 5(*a*) is a detail of the sump and FIG. 5(*b*) is the dispensing system.
Figure 5B:
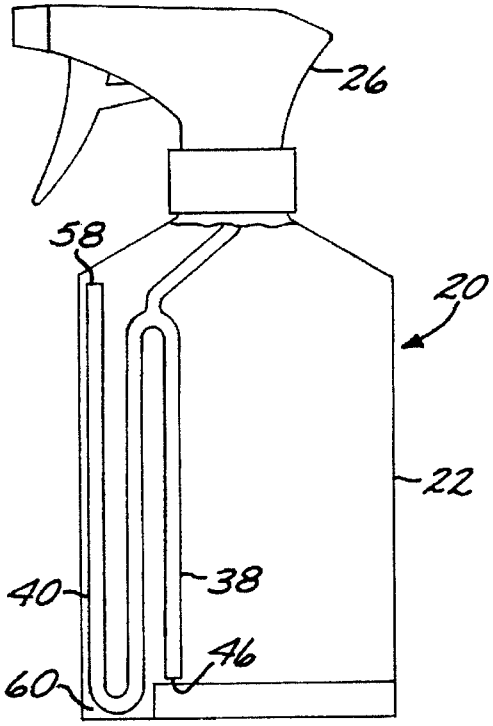
Figure 6A:
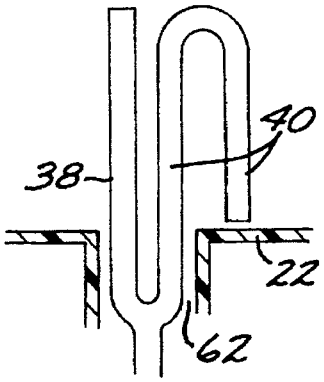
FIGS. 6(*a*)–6(*b*) are schematic sectional views of another embodiment of the dispensing system, utilizing a top sump, wherein FIG. 6(*a*) is a detail of the sump and FIG. 6(*b*) is the dispensing system.
Figure 6B:
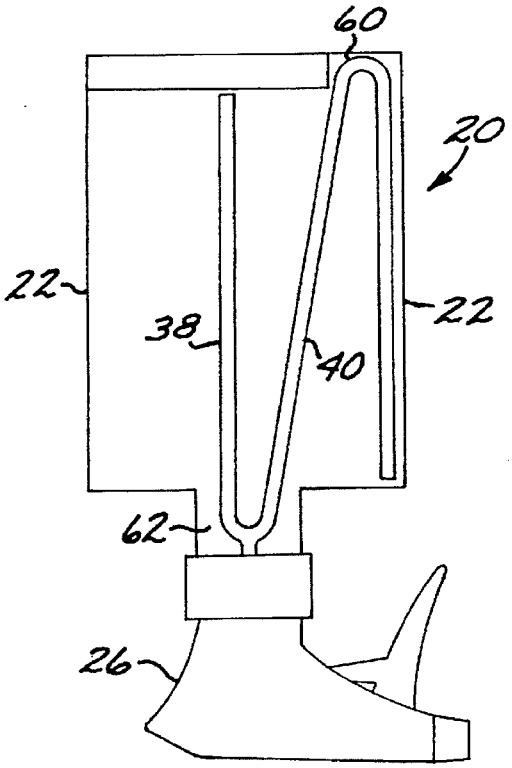

FIGS. 5 and 6 illustrate approaches for overcoming any problem which might be experienced in relation to this loss of the priming of the liquid transfer device. In FIG. 5, the container 22 has a bottom sump 60 recessed into the bottom of the container 22. The lower or U-shaped region of the U-shaped portion of the dip tube 40 is positioned within the bottom sump 60. The depth of the bottom sump 60 is greater than the height that the liquid drops during dispensing. This height is 0.9 inches for the typical hand pump as discussed previously, but is readily determined for any liquid transfer device of interest. Air cannot reach the bottom of the U-shaped tube until all liquid is dispensed from the container 22, leaving only that liquid in the bottom sump 60 and the dip tubes. In this design, air cannot fill the dip tube assembly and prevent the dispensing of the fluid when the container is in the upright position.

FIG. 6 illustrates a related approach useful when the container 22 is operated in the inverted position. The container 22 has a top sump 62 (i.e., a neck) in addition to the bottom sump 60. The top sump 62 functions in the same manner as the bottom sump 60, discussed previously.

Figure 7A:
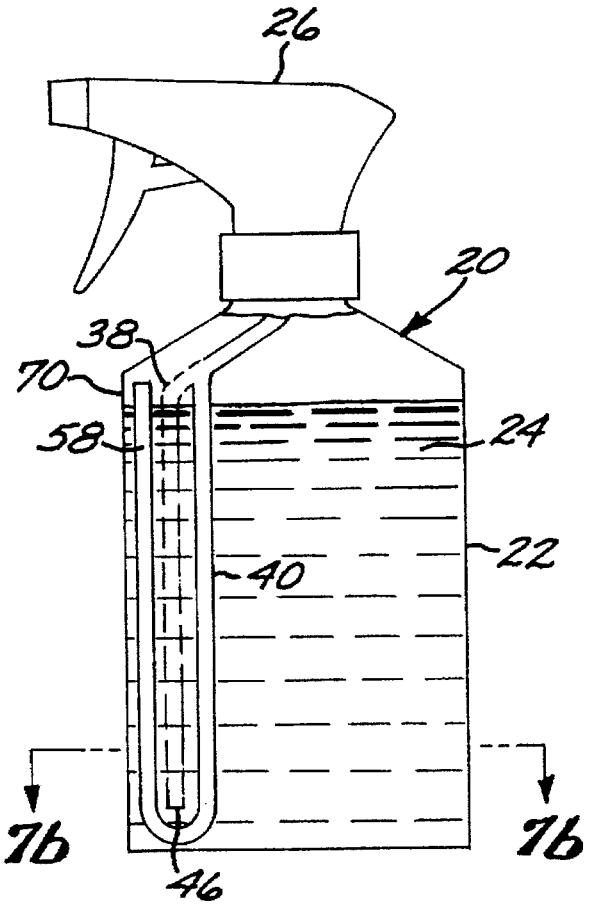
FIGS. 7(*a*)–7(*b*) are schematic views of the dispensing system with the dip tube open ends positioned adjacent to a wall of the interior of the container, wherein FIG. 7(*a*) is a longitudinal sectional view and FIG. 7(*b*) is a vertical sectional view.
Figure 7B:
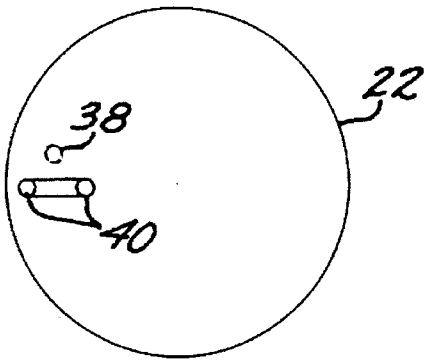
Figure 8:
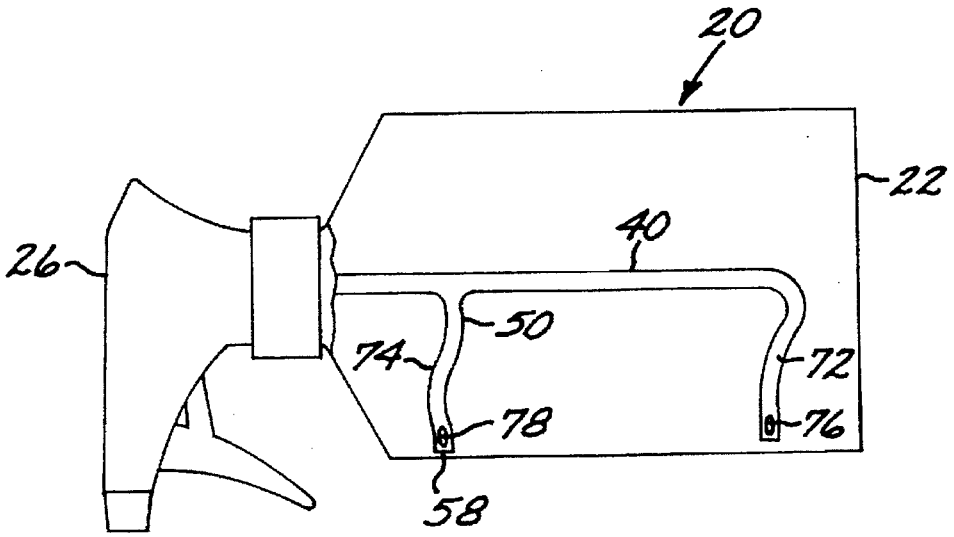
FIG. 8 is a schematic view of another embodiment of the dispensing system wherein weights are used to cause the open ends of the dip tube to be positioned adjacent to a wall of the interior of the container.

The dispensing system of FIGS. 1 is operable over a range of inclinations of the container to the vertical, the extent of the range depending upon the liquid level in the container. However, it is preferred that the dispensing system be operable in all intermediate inclined or horizontal positions between the vertical positions shown in FIGS. 1. FIGS. 7 and 8 illustrate two approaches that achieve this end.

In FIG. 7, the straight portion 38 and the U-shaped portion 40 of the dip tube are positioned with their open ends 46 and 58 in close proximity to a wall portion 70 of the interior of the container 22, in this case the illustrated left-hand wall portion. When the container 22 is reoriented from the vertical upright toward the vertical inverted positions by rotation in a counter-clockwise direction in the view of FIG. 5, at least one, and sometimes both, of the open ends 46 and 58 remain below the level of the liquid in the container 22. This embodiment is particularly useful when the dispensed liquid is paint or other liquid which can dry in the dip tube or in the liquid transfer device after dispensing is complete, and thereby clog the dispensing system so that a subsequent use is difficult. If the container 22 is rotated in the opposite, clockwise direction from the vertical in the view of FIG. 5, neither of the open ends 46 and 58 contact the fluid. In this orientation, the liquid transfer device is operated to pump air through the dispensing system to remove any remaining liquid from the dip tube and the liquid transfer device.

The approach of the invention can be made to dispense liquid for any tipping direction relative to a vertical axis, permitting dispensing of liquid straight up, straight down, or at any intermediate angle regardless of the liquid level in the container 22. The liquid transfer device 26 and its nozzle are rotated relative to the dip tube 34 through an interconnection such as a fitting which permits such relative rotation. The dip tube 34 stays stationary either in the bottom of the container or in the bottom sump, if present. (The dip tube 34 could also be made to rotate with the liquid transfer device for some embodiments, if desired, but it is preferred that the dip tube 34 be rotationally stationary.) For example, in the views of FIG. 1(*a*), FIG. 5(*b*), or FIG. 7(*a*), the liquid transfer device 26 can be rotated 180° so as to face to the right rather than to the left. This rotation can be accomplished by loosening the cap of the liquid transfer device and rotating it.

Alternatively, an indexed rotational mechanism can be provided in the cap portion of the liquid transfer device 26. Intermediate rotations can also be performed to direct the nozzle of the liquid transfer device in any desired direction.

In the embodiment of FIG. 8, the ends of the first segment 41 and the third segment 50 are made flexible, as shown at numerals 72 and 74, respectively. Respective weights 76 and 78 are attached to the flexible segments 72 and 74 near their respective ends 46 and 58. Whether the container 22 is oriented in a vertical upright, vertical inverted, inclined, or horizontal position, at least one of the ends 46 and 58 will reach into the liquid.

Another concern with the dispensing system 20 is to be certain that no air enters the U-shaped portion of the dip tube 38 during vertical inverted operation. This potential problem can be avoided by the placement of the U-shaped portion of the dip tube relative to the air vent 31. As shown in FIGS. 1, the second end 58 of the second segment 50 of the U-shaped portion of the dip tube 40 is disposed remote from, and preferably diametrically opposite from, the air vent 31. Ambient air entering the container 22 when the container is vertically inverted floats upwardly into the liquid at a location remote from the second end 58, and therefore cannot be drawn into the second end 58.

The present invention has been reduced to practice and found operable

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A dip tube used in combination with a container and a liquid transfer device operable to transfer a liquid from the container, the dip tube comprising:

a first segment having a first end in communication with the liquid transfer device inlet and a second end extending to a bottom of an interior of the container, the second end being open;

a second segment having a first end in communication with the liquid transfer device inlet and a second end extending to the bottom of the interior of the container; and a third segment having a first end in communication with the second end of the second segment and a second end extending to a top of the interior of the container, the second end being open.

2. The dip tube of claim 1, wherein the second end of the first segment and the second end of the third segment are both located in proximity to a wall of the interior of the container.

3. The dip tube of claim 1, wherein the first segment, the second segment, and the third segment comprise a respective first internal passage, second internal passage, and third internal passage, and wherein the first internal passage, second internal passage, and third internal passage are sized according to the rate of liquid transfer from the container.

4. A dispensing system, comprising:

a container operable to hold a liquid;

a liquid transfer device having an inlet which receives liquid and transfers the liquid from the container; and a dip tube extending from the inlet into an interior of the container, the dip tube comprising:

a first segment having a first end in communication with the inlet and a second end extending to a bottom of an interior of the container, the second end being open, a second segment having a first end in communication with the inlet and a second end extending to the bottom of the interior of the container, and a third segment having a first end in communication with the second end of the second segment and a second end extending to a top of the interior of the container, the second end being open.

5. The dispensing system of claim 4, wherein the second end of the first segment and the second end of the third segment are both located in proximity to a wall of the interior of the container.

6. The dispensing system of claim 4, wherein the first segment, the second segment, and the third segment comprise a respective first internal passage, second internal passage, and third internal passage, and wherein the first internal passage, second internal passage, and third internal passage are sized according to the rate of liquid transfer from the container.

7. The dispensing system of claim 4, wherein the container includes a top and a top opening, and wherein the liquid transfer device is affixed to the top of the container at the top opening.

8. The dispensing system of claim 7, wherein the liquid transfer device does not leak when the dispensing system is inverted.

9. The dispensing system of claim 4, wherein the liquid transfer device is a hand pump.

10. The dispensing system of claim 4, wherein the liquid transfer device comprises an aerosol valve.

11. The dispensing system of claim 4, further including an air vent extending from the interior of the container to an exterior of the container at a location in proximity to the top opening.

12. The dispensing system of claim 4, further including a bottom sump in a bottom end of the container.

13. The dispensing system of claim 4, wherein the bottom sump receives a portion of the second segment and a portion of the third segment therein.

14. The dispensing system of claim 4, further including a top sump in a top end of the container.

15. The dispensing system of claim 4, wherein the second end of the first segment and the second end of the third segment are positioned adjacent to a wall of the container.

16. A dispensing system, comprising:

a container operable to hold a liquid;

a liquid transfer device having an inlet which receives liquid and transfers the liquid from the container; and a dip tube extending from the inlet into an interior of the container, the dip tube comprising:

a straight portion having a first end in communication with the inlet and a second end extending to a bottom of an interior of the container, the second end being open, a U-shaped portion having a first end in communication with the inlet, a central region extending to the bottom of the interior of the container, and a second end returning to a top of the interior of the container, the second end being open.

* * * * *